US005752369A

United States Patent [19]

Suga

[11] Patent Number: 5,752,369

[45] Date of Patent: May 19, 1998

[54] APPARATUS FOR CONTROLLING OPERATING OF A PACKAGING MACHINE

[75] Inventor: Yasutaka Suga, Ibaraki, Japan

[73] Assignee: Furukawa Mfg. Co., Ltd., Tokyo, Japan

[21] Appl. No.: 734,744

[22] Filed: Oct. 21, 1996

[51] Int. Cl.[6] ..... B65B 31/00

[52] U.S. Cl. ..... 53/511; 53/58; 53/493; 53/76

[58] Field of Search ..... 53/510, 511, 512, 53/432, 433, 434, 51, 55, 58, 493, 496, 498, 500, 75, 76

[56] References Cited

U.S. PATENT DOCUMENTS

| | | | |
|---|---|---|---|
| 4,514,963 | 5/1985 | Bruno | 53/493 |
| 4,640,081 | 2/1987 | Kawaguchi et al. | 53/510 |
| 4,909,018 | 3/1990 | Yamamoto | 523/450 |
| 5,014,489 | 5/1991 | Terminella et al. | 53/51 |
| 5,062,252 | 11/1991 | Kupcikevicius | 53/512 |
| 5,209,043 | 5/1993 | Kupukevicius | 53/512 |
| 5,347,791 | 9/1994 | Ginzl et al. | 53/55 |
| 5,566,526 | 10/1996 | Suga | 53/75 |

FOREIGN PATENT DOCUMENTS

| | | | |
|---|---|---|---|
| 8169406 | 12/1994 | Japan . | |
| 8169406 | 7/1996 | Japan . | |
| 2101957 | 1/1983 | United Kingdom | 53/512 |

*Primary Examiner*—Daniel Moon
*Assistant Examiner*—Ed Tolan
*Attorney, Agent, or Firm*—Barnes, Kisselle, Raisch, Choate, Whittemore & Hulbert, P.C.

[57] ABSTRACT

An apparatus for controlling the operation of a packaging machine of the type which carries out the operations of causing a tube film placed around articles under transport to be cut and sealed between adjacent articles for being successively formed into bags, then causing individual bags, each with an article contained therein, to be conveyed forward by a delivery conveyor, causing the bags to be sequentially transferred from the delivery conveyor onto moving surface plates, causing each surface plate to be covered with a cover member, and then causing the interior of the cover member to be placed under a vacuum atmosphere while the open end of the bag is hermetically sealed. A bag sensor sequentially detects the passage of open ends of bags on the delivery conveyor, and a surface plate detecting sensor sequentially detects the passage of individual surface plates. Information received from the bag sensor and information received from the surface plate detecting sensor are checked against each other for finding relative positional deviation between the bag and the surface plate. Any positional deviation is corrected according to the result of such checking.

5 Claims, 4 Drawing Sheets

APPARATUS FOR CONTROLLING OPERATING OF A PACKAGING MACHINE

FIELD OF THE INVENTION

The present invention relates to an apparatus for controlling operations of a packaging machine. More particularly, the invention relates to an apparatus for controlling operations of a rotary vacuum packaging machine of the type in which a plurality of packages in unfinished condition as transported at predetermined intervals from a packaging unit for forming bags and filling articles therein are sequentially transferred into a plurality of chambers moving on an endless pathway so that the packages in unfinished condition are finished in the form of a vacuum packaged product within the respective chambers.

BACKGROUND ART

A packaging unit for forming bags and filling articles into the bags is employed as functional means for packing the articles efficiently with a bag-like film. By coupling a rotary vacuum packaging machine to such a packaging unit employed for bag forming and article filling, it is possible to carry out operations of covering articles with a bag-like film in vacuum and preventing the articles from oxidation, in succession and at high efficiency. Such a technique is described in, for example, U.S. Pat. No. 4,640,081. In the case where the article is a foodstuff, the foodstuff vacuum packaged into a bag is sterilized, as contained in the bag, by being passed through a hot water bath.

After the above cited invention of U.S. Pat. No. 4,640,081 was made, however, it was found that packages sterilized in such a manner would involve the following problem.

That is, according to the mechanical setup of aforesaid arrangement, transport intervals for the vacuum treating chambers in the rotary vacuum packaging machine are necessarily larger than the transport intervals for packages fed from the packaging unit for forming bags and filling articles in the bags. As such, in a transfer region for transfer of packages from the packaging unit for bag forming and article loading to the vacuum packaging machine, space intervals between individual packages are extended so as to coincide with the chamber-to-chamber space intervals. In that case, however, some delicate error is likely to occur in extension ratio and this makes it impracticable to enable an open end of each package bag to come in precise coincidence with a heat sealing bed for bag end sealing within each chamber. Therefore, in order that an open end of each bag may be precisely sealed, it is necessary that a heat seal line which is to be applied by the sealing bed to the open end of the bag must be intentionally spaced slightly apart from the open end of the bag. This poses a problem that since a pair of narrow film sheet portions remain as such outside of the heat seal line, after the bag is sterilized some water residue may be present in the gap between the pair of film sheet portions, which results in the formation of some blackish fur in the gap.

SUMMARY OF THE INVENTION

Accordingly, it is an object of this invention to provide an apparatus wherein open ends of package bags transported in succession from a packaging unit which performs bag forming and filling operations can be preset for accurate alignment with the sealing bed of a vacuum chamber.

In order to accomplish this object, according to the invention there is provided an apparatus for controlling the operation of a packaging machine of the type which carries out the operations of causing a belt-like film run out continuously to be placed in a tube form around articles transported in spaced apart relation, causing the film tube to be cut and sealed by a pair of seal bars between adjacent articles for being successively formed into bags, then causing individual bags, each with an article contained therein, to be conveyed forward by a delivery conveyor, causing the bags to be sequentially transferred from the delivery conveyor onto surface plates moving in spaced apart relation along an endless pathway, causing each surface plate to be covered with a cover member while the surface plate is in movement along the endless pathway, and then causing the interior of the cover member to be placed under a vacuum atmosphere while at the same time the open end of the bag is hermetically sealed by means of a sealing bed on the surface plate, the apparatus comprising:

a bag sensor for sequentially detecting the passage of open ends of bags on the delivery conveyor;

surface plate sensing means for sequentially sensing the passage of individual surface plates on the endless pathway; and means for checking information received from the bag sensor and information received from the surface plate sensing means against each other to find relative positional deviation between the bag and the surface plate, and correcting the positional deviation according to the finding.

According to this arrangement, after severance of a bag by the pair of seal bars from the tube film, passage of the open edge of the bag is detected by the bag sensor as the bag is conveyed by the delivery conveyor, and passage of a surface plate is detected by the surface plate sensing means. The results of these detections are checked together for finding possible relative positional deviation between the bag and the surface plate, and correction of such deviation, if any, is made on the basis of the finding. This makes it possible to set the open end of the bag at a predetermined position on the surface plate. Therefore, accurate sealing can be effected with respect to the open end of the bag on the surface plate without leaving a gap which may allow possible fur formation.

DESCRIPTION OF THE PREFERRED EMBODIMENTS

Figure 1:
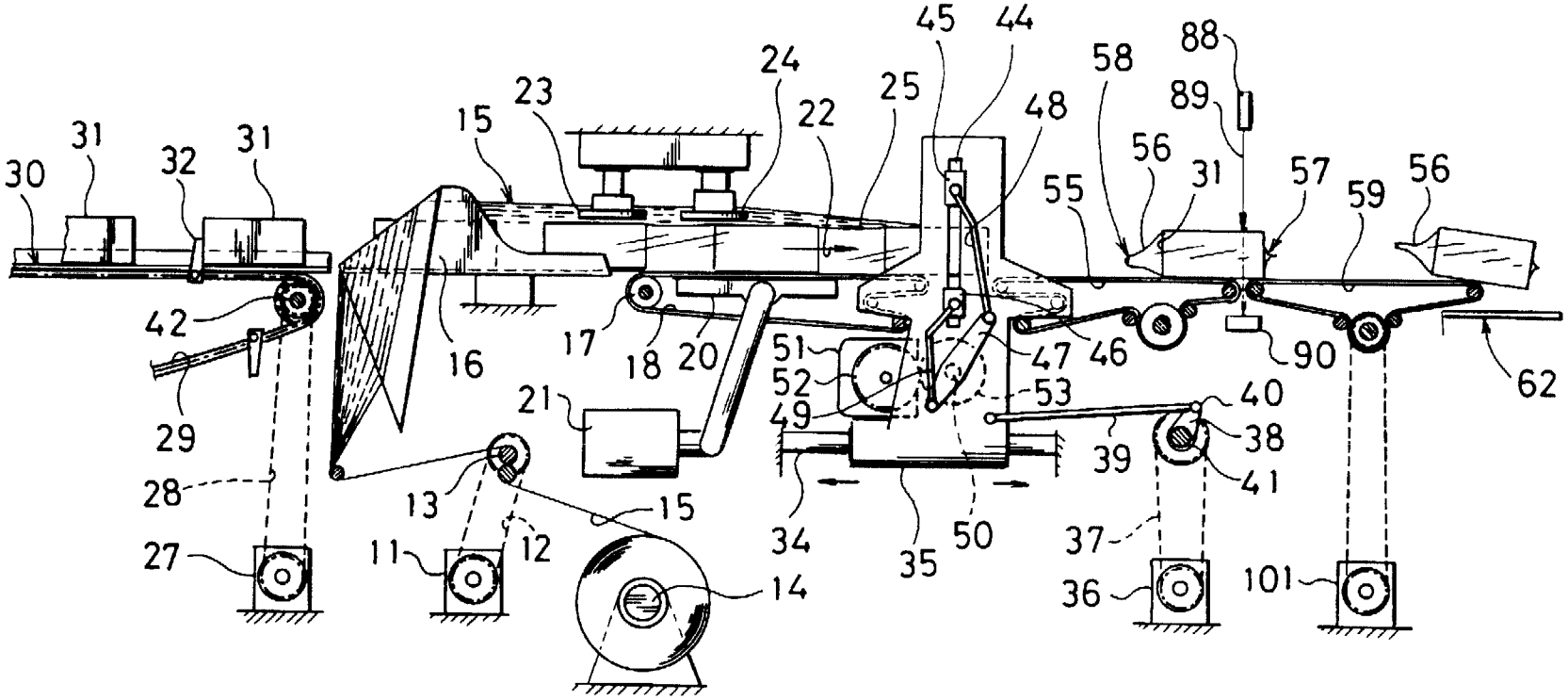
FIG. 1 is a side view of a portion of the apparatus of the invention which represents a packaging unit for forming bags and filling articles into the bags.

As can be seen from FIG. 1 which illustrates one preferred embodiment, a run-out roll 13 to which the driving power of a first motor 11 is transmitted through a chain 12 is operative to run out a belt-like film 15 carried on a shaft 14 at a constant rate and feed the same toward a channel-shaped former 16.

Figure 2:
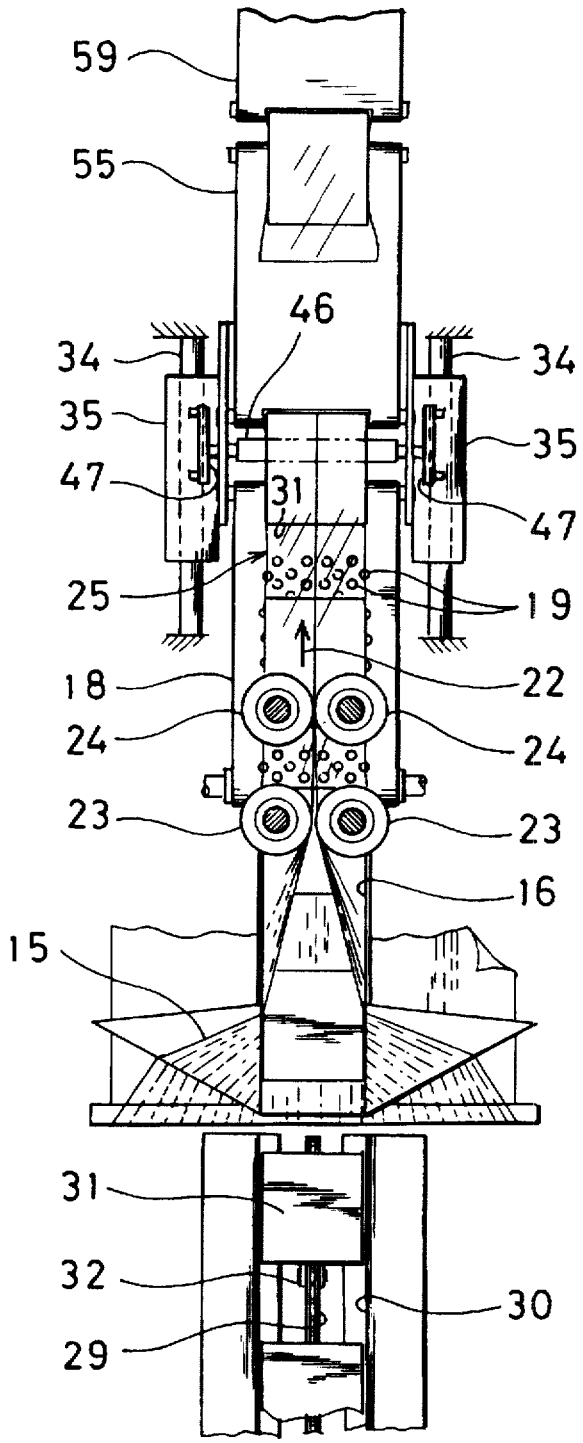
FIG. 2 is a plan view of the portion shown in FIG. 1.

A conveyor belt 18 disposed ahead of the former 16 and driven to run horizontally under a driving force of a pulley 17 has a multiplicity of small suction holes 19 as shown in FIG. 2. Disposed along the underside of the belt 18 is a chamber 20 to which a suction force of a vacuum pump 21 is applied so that film 15 is sucked onto the conveyor belt 18 under the suction force of the suction holes 19, being thus conveyed under the travelling force of the conveyor belt 18 in the direction of arrow 22.

With a force of transport applied to the film 15 in this way, the film 15 is folded into a channel-like shape according to the configuration of the former 16 and then opposite side edges of the film 15 are picked up by a pair of rollers 23 in face-to-face relation, being then fusion bonded together by a pair of rollers 24 disposed ahead of the rollers 23. In this way, film 15 is successively formed into a tube film 25.

A chain conveyor 29 to which the driving power of a second motor 27 is applied causes an attachment 32 to apply a pushing force thereof to an article 31 on a guide plate 30 extending in a horizontally linear direction. In this manner, individual articles 31 are transported at equal space intervals through an inlet portion of the former 16 into a channel-form film 15. As a result, each article 31 is covered all over with a film 15 in the form of a tube, and a tube film 25 thus formed is transported forward in integral relation with the article 31 enclosed therein.

A frame 35 supported on a guide rail 34 parallel to a transport pathway for tube film 25 is connected through a connecting rod 39 to a crank plate 38 which receives a driving power of a third motor 36 through a chain 37. Therefore, the frame 35 moves back and forth along the guide rail 34 in a cycle of rotation of a crank pin 40.

In order to enable the foregoing operations to be performed, it is necessary that the cycle time required for one back and forth movement of the frame 35 must always coincide with the pitch of feed of articles 31 by the chain conveyor 29. Therefore, a rotary shaft 41 for the crank plate 38 and a pulley shaft 42 for the chain conveyor 29 may be both driven by one motor without involving any problem of control.

A pair of seal bars 45, 46, upper and lower, are slidably supported in a vertically elongate slit 44 formed in the frame 35. The seal bars 45, 46 are coupled via links 48, 49 to opposite ends of a bell-crank 47 disposed at a location lower than the seal bars 45, 46. A rotary shaft 50 of the bell-crank 47 and the shaft of a fourth motor 51 carried on the frame 35 are interlocked with each other by means of a pair of intermeshing gears 52, 53. Therefore, when the bell-crank 47 is driven forward and reverse by a forward-and-reverse driving power of the fourth motor 51, the pair of upper and lower seal bars 45, 46 are caused to open and close in unison at predetermined time intervals and, during their closing movement, the pair of seal bars 45, 46 go into abutment against each other. Thus, when the back and forth movement of the frame 35 is coincided with the open and close movement of the seal bars 45, 46, the pair of seal bars 45, 46 move along an elliptic pathway to cut and seal tube film 25 between each two adjacent articles 31. More specifically, the seal bars 45, 46 open the trail edge of film 25 for a preceding article 31 under transport and seal the lead edge of film 25 for a succeeding article 31 under transport, and cut the film 25 between the preceding article 31 and the succeeding article 31. In this case, as may be understood clearly from the condition of a bag 56 on a first delivery conveyor 55 as depicted in FIG. 1, while the lead end of the bag 56 is hermetically sealed, the trail end 58 is still open.

When each bag 56 is severed from the tube film 25, the article 31 within the bag 56 is moved away from a succeeding article by the first delivery conveyor 55 which runs faster than the conveyor belt 18, being then transferred onto a second delivery conveyor 59 which runs at a lower speed.

Figure 3:
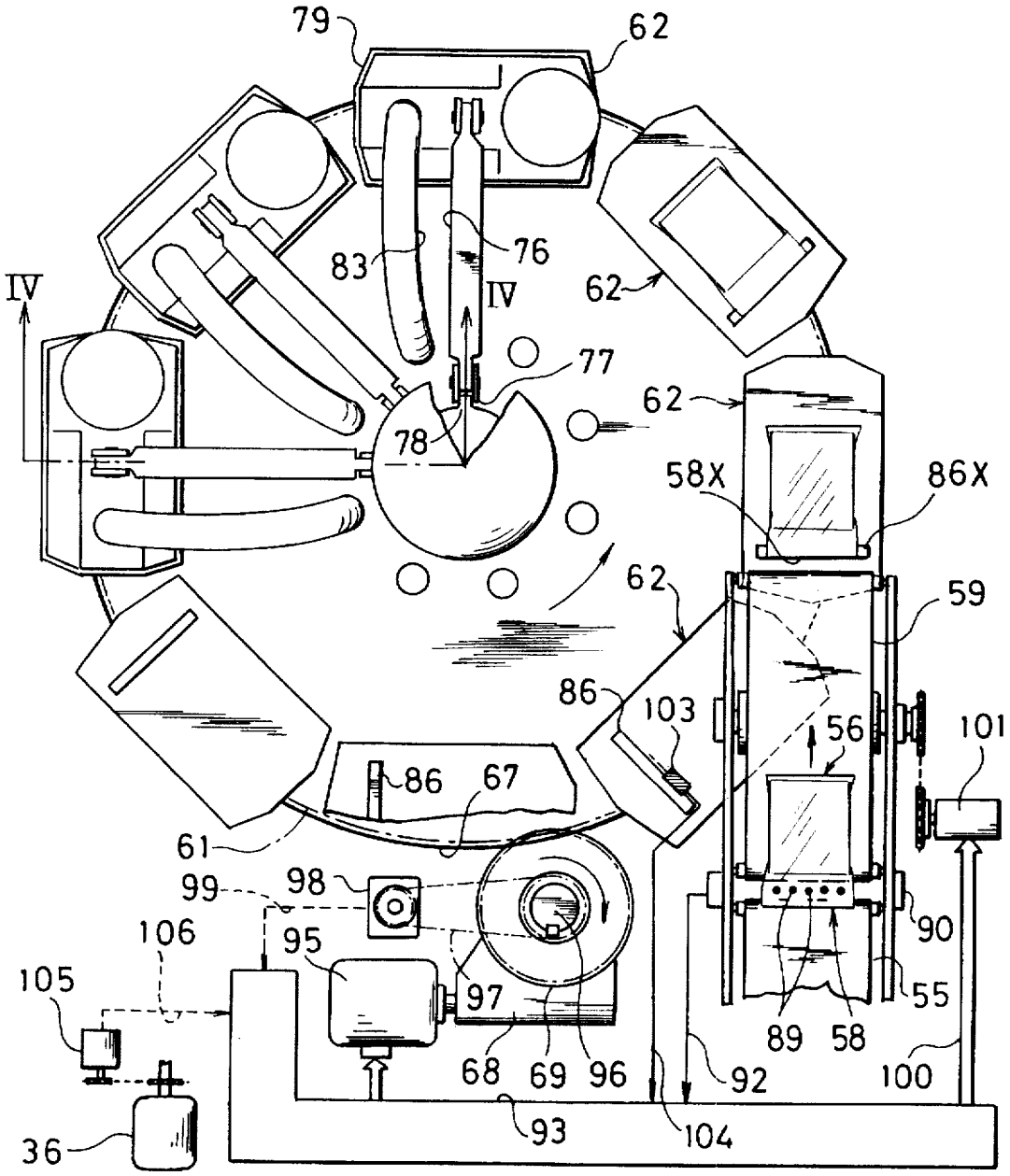
FIG. 3 is a plan view of a portion of the apparatus of the invention which represents a rotary vacuum packaging machine.

As FIG. 3 shows, eight horizontally planar surface plates 62 are arranged on a horizontally rotatable circular board 61 in circumferentially equispaced relation, and are adapted to rotate integrally with the circular board 61 and at the same speed as the second delivery conveyor 59. Accordingly, individual bags 56 are transferred in succession from the second delivery conveyor 59 onto respective surface plates 62.

Figure 4:
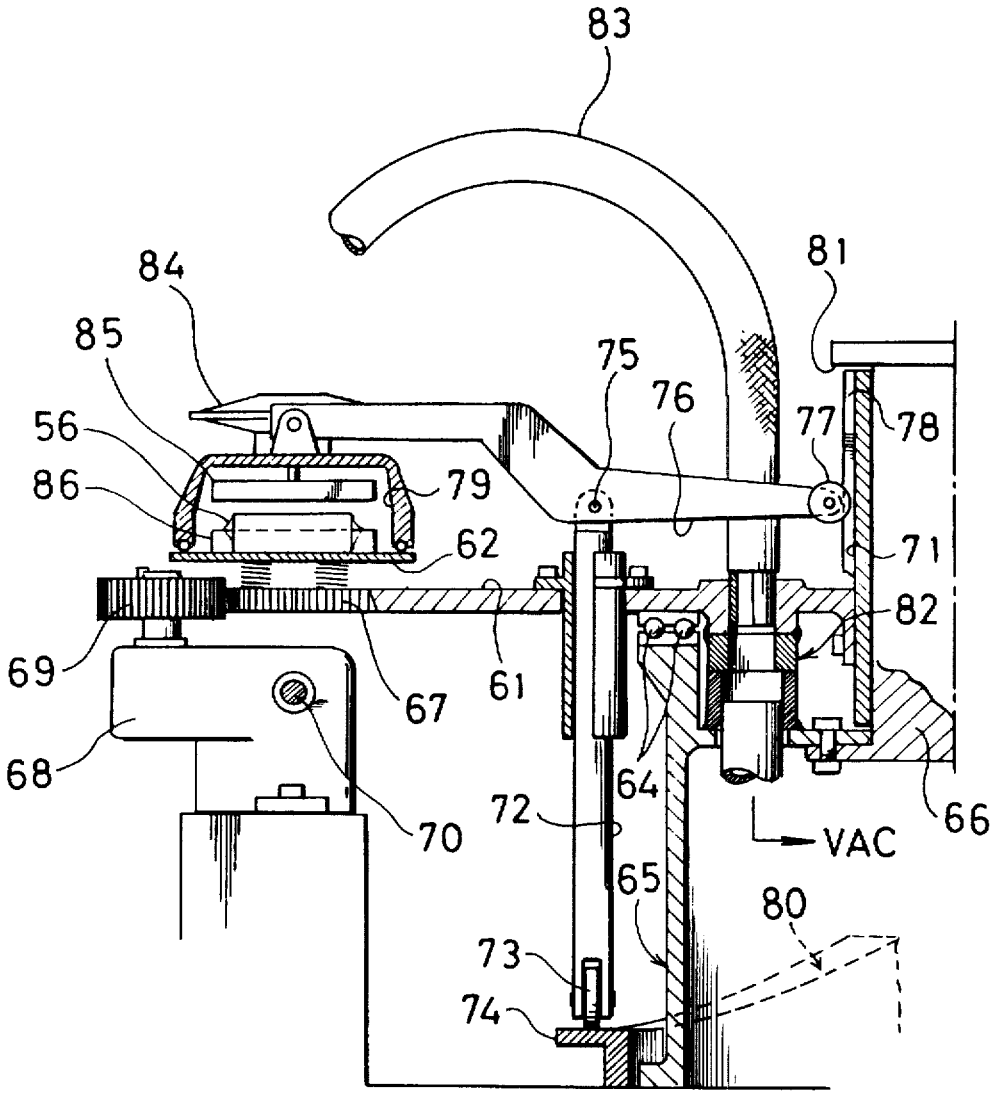
FIG. 4 is a section taken along the line IV—IV in FIG. 3.

As may be seen from FIG. 4 which shows a fragmentary sectional view of the portion shown in FIG. 3, the circular board 61 is supported through a thrust bearing 64 and a sleeve 71 for rotation about a main shaft 66 which vertically extends centrally of a machine frame 65. The circular board 61 is formed on its circumferential edge with a multiplicity of teeth to define a gear 67 which comes in mesh engagement with an output pinion 69 of a reduction gear 68, whereby the circular board 61 is caused to rotate integrally with the sleeve 71 about the main shaft 66 by a power input through a motor shaft 70.

Eight rod members 72 which vertically slidably extend through the circular board 61 are provided at their lower ends with rollers 73. Each of the rollers 73 rests on a circular cam rail 74 which surrounds the machine frame 65. Each rod member 72 supports, at its upper end, through a horizontal pin 75 an arm 76 which extends horizontally at right angles to the pin 75. The arm 76 is provided at one end with a roller 77 which engages a guide rail 78 extending vertically on the exterior of the sleeve 71. At the other end of the arm 76 there is suspendedly supported a cover member 79 which is positioned above one of the surface plates 62.

The cam rail 74 has an upper surface 80 which defines a predetermined gradient such that when the roller 73 which is movable on the cam rail 74 in rolling contact therewith ascends the slope of the upper surface 80 so that the rod member 72 is elevated until the roller 77 strikes a stopper 81 at the upper end of the main shaft 66, the arm 76 is caused to rotate so that the cover member 79 moves upward away from the surface plate 62. When the roller 73 descends the slope of the upper surface 80 until the cover member 79 covers the surface plate 62, the interior of the cover member 79 is brought in communication with a vacuum source through a rotary valve 82 and a hose 83. Thus, in a vacuum atmosphere an open end of bag 56 is heat sealed between a heater member 85 lowered by a working pressure from an actuator 84 and a seal bed 86 located therebelow.

Problems encountered before this invention was made are as follows. Immediately after a bag 56 was severed from the tube film 25 by means of seal bars 45, 46, upper and lower, there occurred some deviations with respect to the pitch of bag transport. The reason for this is that since the first delivery conveyor 55 runs at a higher speed than the feed rate of the tube film 25, which causes an increase in the distance between adjacent bags 56, some slippage occurs momentarily between the first delivery conveyor 55 and the bag 56 the instant the bag 56 is severed from the tube film 25, with the result that some indefinite deviation occurs in the spacing between the adjacent bags 56.

According to the present invention, the gap between the terminal end of the first delivery conveyor 55 and the starting end of the second delivery conveyor 59 is in such a way that an image sensor or bag sensor 90 disposed at a lower level which receives light beams 89 from a lighting member 88 reacts the moment a trail edge of bag 56 leaves the lighting zone of light beams 89.

More specifically, as FIG. 3 illustrates, bag 56 blocks a plurality of light beams arranged in a horizontal row, but when the trail edge 58 of the bag goes past the light beam zone 89, the light beams 89 are detected by the bag sensor 90 and accordingly a detection signal 92 is transmitted from the bag sensor 90 to a controller 93. Whilst, information on the angle of shaft rotation of a fifth motor 95 which drives the circular board 61 is converted into a pulse signal 99 by a pulse generator 98 which is geared to a shaft 96 of the reduction gear 68 via a chain 97, the pulse signal 99 being transmitted to the controller 93. Thus, the position of surface plate 62 in the course of movement is constantly detected by the controller 93. The controller 93 compare the two signals 92, 99, and each time a relative positional deviation between bag edge 58 and seal bed 86 on surface plate 62 is detected, an instruction signal is caused to be transmitted for deceleration or acceleration of a sixth motor 101, whereby correction is made with respect to bag 56 on the second delivery conveyor 59. Thus, the position of trail end 58X of bag 56 at the time of transfer onto surface plate 62 goes in precise agreement with the position of sealing bed 86X.

Infrared type seal bed sensors 103 arranged in an outer circumferential region of the circular board 61 detect the timing of passage of respective sealing beds 86, thereby detecting the pitch of space setting between respective sealing beds 86. A signal 104 on the pitch of space setting is transmitted to the controller 93. The pitch of space setting between respective sealing beds 86 may involve some error attributable to the stage of fabrication, but by utilizing signal 104 it is possible to accurately detect any relative positional deviation between each bag 56 and respective sealing bed 86. Thus, it is possible to correct any such positional deviation to a highly acceptable degree.

Next, another embodiment which is different from the foregoing embodiment will be explained. As FIG. 3 shows, information on the angle of shaft rotation of the third motor 36 for back and forth movement of support frame 35 for seal bars 45, 46, that is, the timing for film 25 cutting and sealing by seal bars 45, 46, is converted by encoder 105 into a pulse signal 106 for transmission to controller 93. With the pulse signal from the encoder 105 used as a reference signal, the rotation of the fifth motor 95, that is, the rotation speed of the circular board 61, is controlled to a constant level. Each time any positional deviation occurs between respective surface plate 62 and bag 56, fine adjustment is effected by the sixth motor 95 with respect to the speed of movement of surface plate 62. According to such embodiment, the movement of bag 56 on the second delivery conveyor 59 need not be corrected, and this prevents any increase in the longitudinal size of the second delivery conveyor 59.

What is claimed is:

1. An apparatus for controlling the operation of a packaging machine of the type which carries out the operations of causing a belt-like film run out continuously to be placed in a tube form around articles transported in spaced apart relation, causing the film tube to be cut and sealed by a pair of seal bars between adjacent articles for being successively formed into bags, then causing individual bags, each with an article contained therein, to be conveyed forward by a delivery conveyor, causing the bags to be sequentially transferred from the delivery conveyor onto surface plates moving in spaced apart relation along an endless pathway, causing each surface plate to be covered with a cover member while the surface plate is in movement along the endless pathway, and then causing the interior of the cover member to be placed under a vacuum atmosphere while at the same time the open end of the bag is hermetically sealed by means of a heating member of the cover member and a sealing bed on the surface plate, the apparatus comprising:

a bag sensor for sequentially detecting the passage of open ends of bags on the delivery conveyor;

surface plate sensing means for sequentially sensing the passage of a side face of the sealing bed on individual surface plates on the endless pathway; and means for checking information received from the bag sensor and information received from the surface plate sensing means against each other to find relative positional deviation between the open end of the bag to be supplied on the sealing bed and the side face of the sealing bed, and for correcting the positional deviation according to the finding.

2. An apparatus as set forth in claim 1, wherein the means for correcting the relative positional deviation between the open end of the bag on the delivery conveyor and the side face of the sealing bed on any surface plate is operative to accelerate or decelerate the movement of the delivery conveyor in corresponding relation to the pace of the movement of the surface plate along the endless pathway.

3. An apparatus as set forth in claim 2, wherein the surface plate sensing means is operative to derive a signal from a sensor connected to an output shaft of a power supply for moving the surface plate, and the correcting means is operative to accelerate or decelerate the movement of the delivery conveyor on the basis of the signal.

4. An apparatus as set forth in claim 2, further comprising means for successively detecting passage of side faces of sealing beds on respective surface plates, and wherein the correcting means is operative to accelerate or decelerate the movement of the delivery conveyor according to a signal from the detecting means which indicates the passage of the side face of each sealing bed.

5. An apparatus as set forth in claim 1, wherein the means for correcting the relative positional deviation between the open end of the bag on the delivery conveyor and the side face of the sealing bed on any surface plate is operative to accelerate or decelerate the movement of the surface plate according to the results of detection by the bag sensor which indicate the passage of an open end of the bag.

* * * * *